US007032400B2

(12) United States Patent
Roche et al.

(10) Patent No.: US 7,032,400 B2
(45) Date of Patent: Apr. 25, 2006

(54) REFRIGERATION UNIT HAVING A LINEAR COMPRESSOR

(75) Inventors: John M. Roche, Ballwin, MO (US); Norm E. Street, O'Fallon, MO (US); Doron Shapiro, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 3 days.

(21) Appl. No.: 10/811,685

(22) Filed: Mar. 29, 2004

(65) Prior Publication Data

US 2005/0210904 A1 Sep. 29, 2005

(51) Int. Cl.
*A47F 3/04* (2006.01)

(52) U.S. Cl. ..... 62/246

(58) Field of Classification Search ..... 62/246–257
See application file for complete search history.

(56) References Cited

U.S. PATENT DOCUMENTS

| | | | | |
|---|---|---|---|---|
| 3,229,475 | A * | 1/1966 | Balk et al. | 62/256 |
| 3,937,600 | A * | 2/1976 | White | 417/416 |
| 4,404,802 | A | 9/1983 | Beale | |
| 4,580,414 | A | 4/1986 | Engelhard | |
| 4,583,364 | A | 4/1986 | Wood | |
| 4,602,174 | A | 7/1986 | Redlich | |
| 4,613,285 | A | 9/1986 | Sato | |
| 4,623,808 | A | 11/1986 | Beale et al. | |
| 4,632,806 | A | 12/1986 | Morikawa | |
| 4,649,283 | A | 3/1987 | Berchowitz et al. | |
| 4,698,576 | A | 10/1987 | Maresca | |
| 4,713,939 | A | 12/1987 | Keith | |
| 4,772,838 | A | 9/1988 | Maresca | |
| 4,805,408 | A | 2/1989 | Beale et al. | |
| 4,808,955 | A | 2/1989 | Godkin | |
| 4,860,543 | A | 8/1989 | Higham | |
| 4,864,232 | A | 9/1989 | Redlich | |
| 4,866,378 | A | 9/1989 | Redlich | |
| 4,912,409 | A | 3/1990 | Redlich et al. | |
| 4,926,123 | A | 5/1990 | Redlich | |
| 4,954,053 | A | 9/1990 | Inoda et al. | |
| 4,965,864 | A | 10/1990 | Roth | |
| 5,003,777 | A | 4/1991 | Berchowitz | |
| 5,079,924 | A | 1/1992 | van der Broeck et al. | |
| 5,125,241 | A | 6/1992 | Nakanishi et al. | |

(Continued)

FOREIGN PATENT DOCUMENTS

| | | |
|---|---|---|
| JP | 10197082 | 7/1998 |

OTHER PUBLICATIONS

Richard Babyak; Calling on Compressors, Efficiency goals inspire innovative designs; http://www.ammagazine.com/CDA/ArticleInformation/features/BNP_Features_Item; Jun. 6, 2000; 6 pages.

(Continued)

*Primary Examiner*—William E. Tapolcai
(74) *Attorney, Agent, or Firm*—Michael Best & Friedrich LLP

(57) ABSTRACT

A refrigeration merchandiser including at least one surface at least partially defining an environmental space adapted to accommodate a commodity. The merchandiser includes a linear compressor, a condenser, an expansion device, and an evaporator. The linear compressor, which can be a free-piston linear compressor having dual-opposing pistons, the condenser, the expansion valve and the evaporator are all in fluid communication. The evaporator is in thermal communication with the environmental space to influence the temperature of the environmental space. A merchandiser also includes a frame supporting the at least one surface, the linear compressor, the condenser, the expansion device, and the evaporator.

48 Claims, 6 Drawing Sheets

U.S. PATENT DOCUMENTS

| | | | | |
|---|---|---|---|---|
| 5,127,235 | A | 7/1992 | Nakanishi et al. | |
| 5,148,066 | A | 9/1992 | Beale et al. | |
| 5,255,521 | A | 10/1993 | Watanabe | |
| 5,257,915 | A | 11/1993 | Laskaris | |
| 5,261,799 | A | 11/1993 | Laskaris | |
| 5,318,412 | A | 6/1994 | Laskaris | |
| 5,342,176 | A | 8/1994 | Redlich | |
| 5,385,021 | A | 1/1995 | Beale | |
| 5,438,848 | A | 8/1995 | Kim et al. | |
| 5,440,894 | A | 8/1995 | Schaeffer et al. | |
| 5,450,521 | A | 9/1995 | Redlich | |
| 5,457,956 | A | 10/1995 | Bowman et al. | |
| 5,461,859 | A | 10/1995 | Beale et al. | |
| 5,496,153 | A | 3/1996 | Redlich | |
| 5,502,968 | A | 4/1996 | Beale | |
| 5,522,214 | A | 6/1996 | Beckett | |
| 5,525,845 | A | 6/1996 | Beale et al. | |
| 5,535,593 | A | 7/1996 | Wu et al. | |
| 5,537,820 | A | 7/1996 | Beale et al. | |
| 5,579,653 | A | 12/1996 | Sugiyama et al. | |
| 5,592,073 | A | 1/1997 | Redlich | |
| 5,600,961 | A | 2/1997 | Whipple, III | |
| 5,628,202 | A | 5/1997 | Lee | |
| 5,642,088 | A | 6/1997 | Unger | |
| 5,642,622 | A | 7/1997 | Berchowitz et al. | |
| 5,654,596 | A | 8/1997 | Nasan et al. | |
| 5,693,991 | A | 12/1997 | Hiterer | |
| 5,715,693 | A | 2/1998 | van der Walt et al. | |
| 5,722,817 | A | 3/1998 | Park | |
| 5,741,120 | A | 4/1998 | Bass et al. | |
| 5,749,226 | A | 5/1998 | Bowman et al. | |
| 5,775,273 | A | 7/1998 | Beale | |
| 5,809,792 | A | 9/1998 | Song | |
| 5,813,569 | A | 9/1998 | Cihanek | |
| 5,818,131 | A | 10/1998 | Zhang | |
| 5,873,246 | A | 2/1999 | Beale | |
| 5,941,079 | A | 8/1999 | Bowman et al. | |
| 5,945,748 | A | 8/1999 | Park | |
| 5,947,693 | A | 9/1999 | Yang | |
| 5,947,708 | A | 9/1999 | Park | |
| 5,980,211 | A | 11/1999 | Tojo et al. | |
| 5,992,165 | A | 11/1999 | Kim et al. | |
| 5,993,175 | A | 11/1999 | Kim et al. | |
| 5,993,178 | A | 11/1999 | Park et al. | |
| 6,000,232 | A | 12/1999 | Witten-Hannah et al. | |
| 6,024,544 | A | 2/2000 | Kim et al. | |
| 6,032,469 | A | 3/2000 | Kim et al. | |
| 6,035,637 | A | 3/2000 | Beale et al. | |
| 6,038,874 | A | 3/2000 | van der Walt et al. | |
| 6,047,557 | A | 4/2000 | Pham et al. | |
| 6,060,810 | A | 5/2000 | Lee | |
| 6,074,172 | A | 6/2000 | Huang | |
| 6,077,054 | A | 6/2000 | Lee et al. | |
| 6,082,132 | A * | 7/2000 | Numoto et al. | 62/498 |
| 6,084,320 | A | 7/2000 | Morita | |
| 6,089,352 | A | 7/2000 | Kim et al. | |
| 6,089,836 | A | 7/2000 | Seo | |
| 6,092,999 | A | 7/2000 | Lili et al. | |
| 6,097,125 | A | 8/2000 | Park et al. | |
| 6,118,235 | A | 9/2000 | Redlich | |
| 6,127,750 | A | 10/2000 | Dadd | |
| 6,129,527 | A | 10/2000 | Donahoe et al. | |
| 6,138,459 | A | 10/2000 | Yatsuzuka et al. | |
| 6,152,710 | A | 11/2000 | Oh et al. | |
| 6,153,951 | A | 11/2000 | Morita et al. | |
| 6,170,442 | B1 | 1/2001 | Beale | |
| 6,174,141 | B1 | 1/2001 | Song et al. | |
| 6,176,683 | B1 | 1/2001 | Yang | |
| 6,184,597 | B1 | 2/2001 | Yamamoto et al. | |
| 6,199,381 | B1 | 3/2001 | Unger et al. | |
| 6,202,791 | B1 | 3/2001 | Oh et al. | |
| 6,205,792 | B1 | 3/2001 | Anderson | |
| 6,220,393 | B1 | 4/2001 | Oh et al. | |
| 6,231,310 | B1 | 5/2001 | Tojo et al. | |
| 6,238,192 | B1 | 5/2001 | Lee | |
| 6,250,895 | B1 | 6/2001 | Kawahara et al. | |
| 6,252,315 | B1 | 6/2001 | Heo | |
| 6,266,963 | B1 | 7/2001 | Rudick | |
| 6,272,867 | B1 | 8/2001 | Barrash et al. | |
| 6,273,688 | B1 | 8/2001 | Kawahara | |
| 6,286,326 | B1 * | 9/2001 | Kopko | 62/179 |
| 6,289,680 | B1 | 9/2001 | Oh et al. | |
| 6,293,184 | B1 | 9/2001 | Unger | |
| 6,299,421 | B1 | 10/2001 | Oh et al. | |
| 6,326,706 | B1 | 12/2001 | Zhang | |
| 6,328,544 | B1 | 12/2001 | Kawahara et al. | |
| 6,339,876 | B1 | 1/2002 | Lee | |
| 6,347,523 | B1 | 2/2002 | Barrash et al. | |
| 6,347,524 | B1 | 2/2002 | Barrash et al. | |
| 6,378,313 | B1 | 4/2002 | Barrash | |
| 6,381,972 | B1 | 5/2002 | Cotter | |
| 6,393,852 | B1 | 5/2002 | Pham et al. | |
| 6,398,523 | B1 | 6/2002 | Hur et al. | |
| 6,408,635 | B1 | 6/2002 | Pham et al. | |
| 6,409,484 | B1 | 6/2002 | Hyun | |
| 6,413,057 | B1 | 7/2002 | Hong et al. | |
| 6,425,255 | B1 * | 7/2002 | Hoffman | 62/261 |
| 6,435,842 | B1 | 8/2002 | Song | |
| 6,437,524 | B1 | 8/2002 | Dimanstein | |
| 6,438,974 | B1 | 8/2002 | Pham et al. | |
| 6,446,336 | B1 | 9/2002 | Unger | |
| 6,449,972 | B1 | 9/2002 | Pham et al. | |
| 6,467,276 | B1 | 10/2002 | Chung et al. | |
| 6,467,280 | B1 | 10/2002 | Pham et al. | |
| 6,481,216 | B1 | 11/2002 | Simmons et al. | |
| 6,491,506 | B1 | 12/2002 | Oh et al. | |
| 6,494,293 | B1 | 12/2002 | Jung | |
| 6,499,305 | B1 | 12/2002 | Pham et al. | |
| 6,501,240 | B1 | 12/2002 | Ueda et al. | |
| 6,506,032 | B1 | 1/2003 | Kawahara | |
| 6,512,343 | B1 | 1/2003 | Yasohara | |
| 6,524,075 | B1 | 2/2003 | Hwang et al. | |
| 6,527,519 | B1 | 3/2003 | Hwang et al. | |
| 6,532,749 | B1 | 3/2003 | Rudick et al. | |
| 6,536,326 | B1 | 3/2003 | Unger et al. | |
| 6,537,034 | B1 | 3/2003 | Park et al. | |
| 6,540,485 | B1 | 4/2003 | Nora et al. | |
| 6,541,953 | B1 | 4/2003 | Yoo | |
| 6,554,577 | B1 | 4/2003 | Park et al. | |
| 6,565,327 | B1 | 5/2003 | Yoo et al. | |
| 6,565,332 | B1 | 5/2003 | Kawahara et al. | |
| 6,571,917 | B1 | 6/2003 | Hyum | |
| 6,575,716 | B1 | 6/2003 | Morita | |
| 6,595,105 | B1 | 7/2003 | An et al. | |
| 6,616,414 | B1 | 9/2003 | Yoo et al. | |
| 6,619,052 | B1 * | 9/2003 | Nash, Jr. | 62/89 |
| 6,623,246 | B1 | 9/2003 | Hwang et al. | |
| 6,626,651 | B1 | 9/2003 | Akazawa et al. | |
| 6,641,377 | B1 | 11/2003 | Toyama et al. | |
| 6,644,943 | B1 | 11/2003 | Lilie et al. | |
| 6,647,735 | B1 | 11/2003 | Street et al. | |
| 6,657,326 | B1 | 12/2003 | Yamamoto et al. | |
| 6,663,351 | B1 * | 12/2003 | Joo | 417/53 |
| 6,671,543 | B1 | 12/2003 | Carrillo | |
| 6,682,310 | B1 | 1/2004 | Yoo et al. | |
| 6,684,637 | B1 | 2/2004 | Beale | |
| 6,685,438 | B1 | 2/2004 | Yoo et al. | |
| 6,705,892 | B1 | 3/2004 | Kim | |
| 6,715,301 | B1 | 4/2004 | Song | |
| 6,742,998 | B1 | 6/2004 | Kawahara et al. | |
| 6,753,665 | B1 | 6/2004 | Ueda et al. | |
| 6,755,627 | B1 | 6/2004 | Chang | |
| 6,766,823 | B1 | 7/2004 | Hong | |
| 6,779,982 | B1 | 8/2004 | Heo | |

| | | | |
|---|---|---|---|
| 6,802,700 | B1 | 10/2004 | Shin |
| 2001/0039802 | A1 | 11/2001 | Barrash |
| 2002/0020175 | A1 | 2/2002 | Street et al. |
| 2003/0044286 | A1 | 3/2003 | Kim |
| 2003/0099550 | A1 | 5/2003 | Kim |
| 2003/0099558 | A1 | 5/2003 | Chang |
| 2003/0108430 | A1 | 6/2003 | Yoshida et al. |
| 2003/0129063 | A1 | 7/2003 | Jeun |
| 2003/0161734 | A1 | 8/2003 | Kim |
| 2003/0161735 | A1 | 8/2003 | Kim et al. |
| 2003/0173834 | A1 | 9/2003 | McGill |
| 2003/0173836 | A1 | 9/2003 | Inogaki et al. |
| 2003/0177773 | A1 | 9/2003 | Kim |
| 2003/0213256 | A1 | 11/2003 | Ueda et al. |
| 2003/0218854 | A1 | 11/2003 | Dimanstein |
| 2003/0231963 | A1 | 12/2003 | Lee et al. |
| 2004/0005222 | A1 | 1/2004 | Yoshida |
| 2004/0042904 | A1 | 3/2004 | Kim |
| 2004/0052568 | A1 | 3/2004 | Gueret |
| 2004/0055458 | A1 | 3/2004 | Monk et al. |
| 2004/0061583 | A1 | 4/2004 | Yumita |
| 2004/0066097 | A1 | 4/2004 | Kobayaski et al. |
| 2004/0074700 | A1 | 4/2004 | Lilie |
| 2004/0088999 | A1 | 5/2004 | Unuger et al. |
| 2004/0101413 | A1 | 5/2004 | Inagaki et al. |
| 2004/0103674 | A1 | 6/2004 | Boer et al. |
| 2004/0108825 | A1 | 6/2004 | Lee et al. |
| 2004/0113509 | A1 | 6/2004 | Lilie |
| 2004/0115076 | A1 | 6/2004 | Lilie |
| 2004/0119434 | A1 | 6/2004 | Dadd |

OTHER PUBLICATIONS

SUNPOWER; Compressors, Linear Compressors for Refrigeration and Other Applications; http://www.sunpower.com/technology/cryo.html; printed Mar. 29, 2004; 2 pages.

SUNPOWER; Compressors, Linear Compressor Commercialization for home refrigeration; http://www.sunpower.com/technology/lg_pics.html; printed Mar. 29, 2004; 2 pages.

SUNPOWER; Linear Compressors for Refrigeration; http://www.sunpower.com/technology/line_comp.html; printed Mar. 29, 2004; 2 pages.

Unger, Reuven; Development and Testing of a Linear Compressor Sized for the European Market; 1999; 7 pages.

Unger, Reuven; Linear Compressors for Clean and Specialty Gases; 1998; 6 pages.

Unger, Reuven, et al.; Linear Compressors for Non-CFC Refrigeration; 1996; 6 pages.

Redlich, Robert, et al.; Linear Compressors: Motor Configuration, Modulation and Systems; 1996; 6 pages.

Van der Walt, et al.; Linear Compressors—A Maturing Technology; 1994; 6 pages.

European Search Report dated Jun. 14, 2005.

* cited by examiner

REFRIGERATION UNIT HAVING A LINEAR COMPRESSOR

FIELD OF THE INVENTION

The present invention relates to a refrigerator having a linear compressor.

BACKGROUND

Supermarket refrigeration has traditionally been accomplished via centralized parallel compressor systems with long liquid and suction branches piped to and from the evaporators in the refrigerated display cases. One example of a refrigeration system including a parallel compressor system is described in U.S. Patent Application Publication No. 2002/0020175, published Feb. 21, 2002, the content of which is incorporated herein by reference. The parallel compressor configuration allows for stepwise capacity modulation via compressor cycling. One typical disadvantage with these systems is that the compressors generate large amounts of acoustic noise. Remotely locating elements (e.g., compressors, condensers) of the system solves the problem of acoustic noise in the retail sales area. However, the remote location results in expensive field piping, large refrigerant charge and leakage, and parasitic heating of the liquid and suction piping.

An alternative to the large, centralized parallel rack refrigeration system is a system used by supermarkets typically referred to as a distributed refrigeration system. An example of a distributed refrigeration system is disclosed in U.S. Pat. No. 5,440,894, issued Aug. 15, 1995, the content of which is incorporated herein by reference. The distributed system is intended for cooling a plurality of fixtures in multiple cooling zones within a shopping area of a food store. The system comprises a condensing unit rack configured to accommodate the maximum refrigeration loads of the associated zones and being constructed to support the components of a closed refrigeration circuit including a plurality of multiplexed compressors and associated high side and low side refrigerant delivery. The system also comprises a suction header extending from the rack and being operatively connected to one or more evaporators. The system also has a condenser with a cooling source remote from the compressor rack but operatively configured to provide a heat exchange relationship. While the distributed refrigeration system is typically closer to the loads (e.g., the merchandisers) as compared to the centralized system, the remote location of the components of the distributed system results in increased field piping, excess refrigerant charge and leakage, and some parasitic heating.

Another alternative to the above systems includes a self-contained, refrigeration display merchandiser comprising multiple horizontal scroll compressors. One example of such a merchandiser is described in U.S. Pat. No. 6,381,972 B1, issued May 7, 2002, the content of which is incorporated herein by reference. The self-contained merchandiser comprising multiple horizontal scroll compressors are relatively quiet when mounted in an insulated box, but lack an efficient low-cost capacity modulation scheme.

A yet another alternative to the above systems include a self-contained, refrigerated display merchandiser having a single reciprocating compressor. The self-contained, refrigerated display case results in little or no field piping, thereby overcoming some of the above-discussed disadvantages of the above systems. However, two disadvantages associated with a self-contained, refrigerated display case having a single reciprocating compressor are that the reciprocating compressor generates too much acoustic noise for the sale floor of the supermarket, and that the unit does not allow for variable capacity control. Because of the lack of variable capacity control, the compressor may perform unnecessary cycling, which may be detrimental to the stored commodity (e.g., sensitive food products) refrigerated by the merchandiser.

It would be beneficial to have another alternative to the above systems and units.

SUMMARY

In one embodiment, the invention provides a refrigeration merchandiser including at least one surface at least partially defining an environmental space adapted to accommodate a commodity. The merchandiser includes a linear compressor, a condenser, an expansion device, and an evaporator. The linear compressor, which can be a free-piston linear compressor having dual-opposing pistons, the condenser, the expansion valve and the evaporator are all in fluid communication. The evaporator is in thermal communication with the environmental space to influence the temperature of the environmental space. The merchandiser also includes a frame supporting the at least one surface, the linear compressor, the condenser, the expansion device, and the evaporator.

In another embodiment, the invention provides a refrigerator having at least one surface at least partially defining an environmental space, a linear compressor, a fluid-cooled condenser, an expansion device, and an evaporator. The linear compressor, the fluid-cooled condenser, the expansion device, and the evaporator are all in fluid communication. The refrigerator further includes a fluid-input line and a fluid-output line, both of which are in fluid communication with the fluid-cooled condenser. The refrigerator also includes a frame supporting the at least one surface, the fluid-input line, the fluid-output line, the compressor, the condenser, the expansion device, and the evaporator.

Features and advantages of the invention will become apparent to those skilled in the art upon review of the following detailed description, claims, and drawings.

DETAILED DESCRIPTION

Before any aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
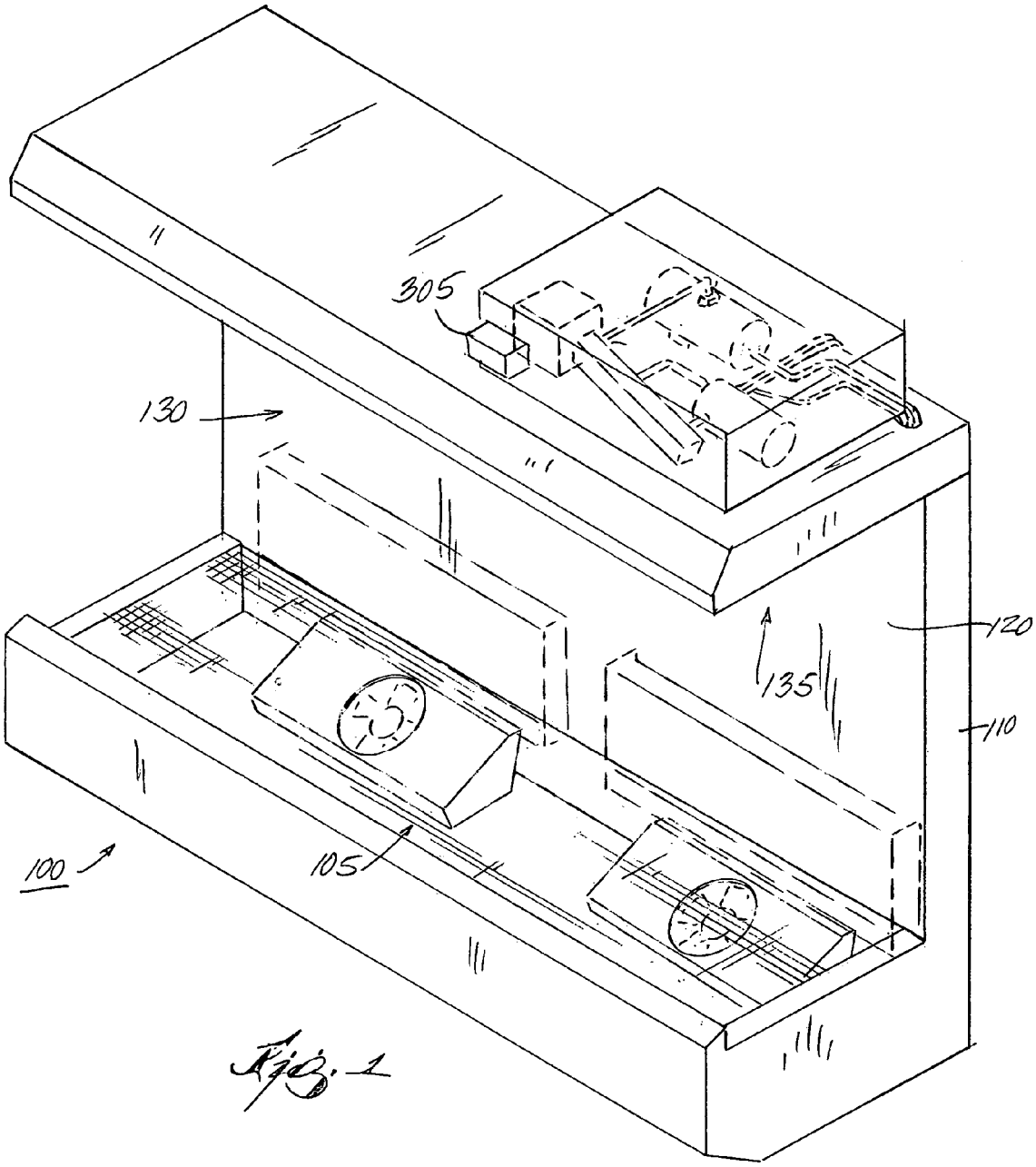
FIG. 1 is a perspective view of a refrigeration merchandiser incorporating the invention.
Figure 2:
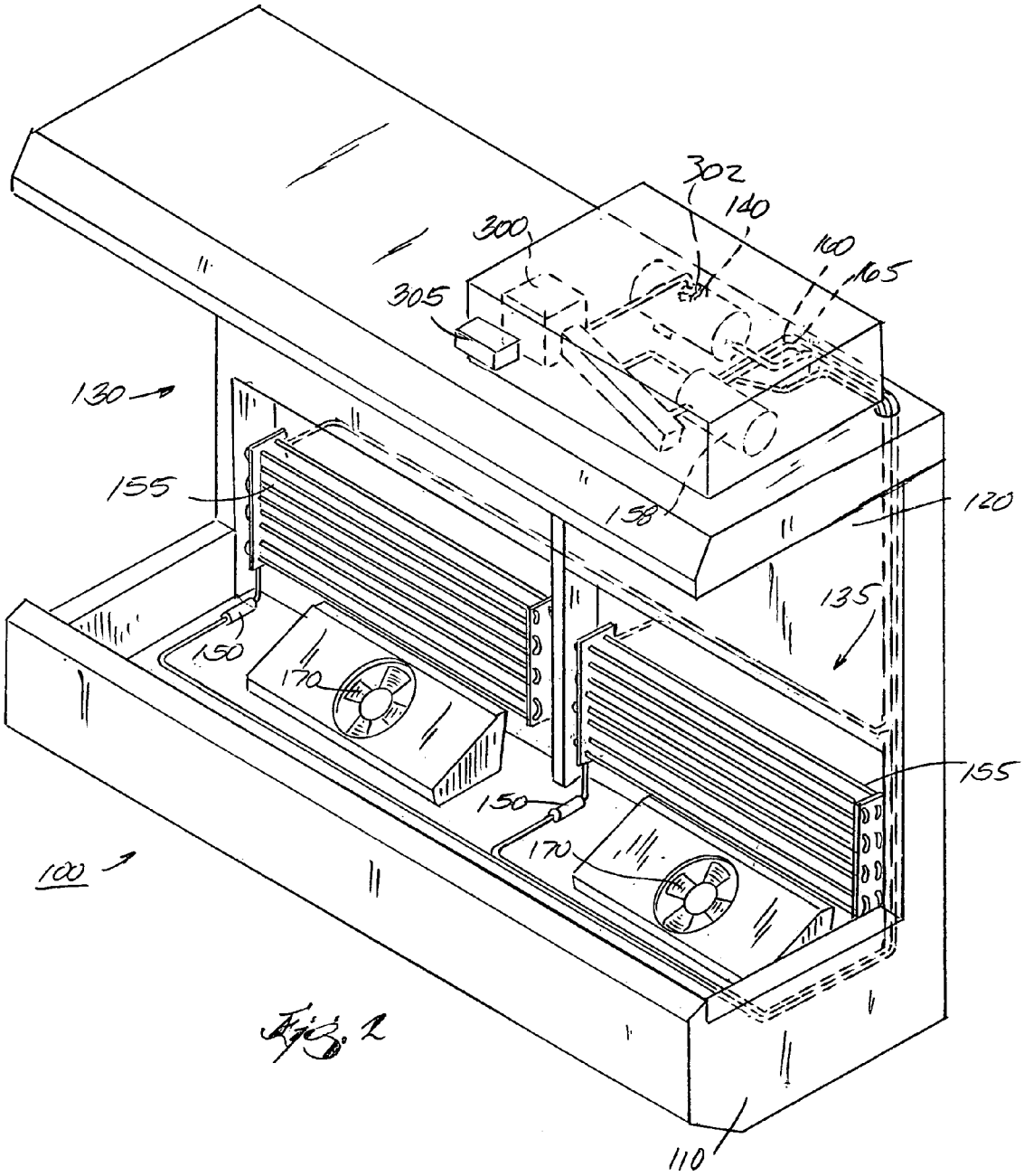
FIG. 2 is a perspective view of the refrigeration merchandiser of FIG. 1 and further showing the elements of the refrigeration cycle of the merchandiser.

FIGS. 1 and 2 shows a self-contained refrigeration merchandiser 100 incorporating the invention. The merchandiser 100 is shown as an open-unit display merchandiser having a single display fixture 105. However, other types of merchandisers (e.g., a glass-door display merchandiser, a vending machine, a dispenser, etc.) can incorporate the invention. Also, it is envisioned that the merchandiser 100 can include more than one display fixture (e.g., is a combination merchandiser), and that some aspects of the invention can be used in non-merchandiser refrigeration units (e.g., a "home" refrigeration unit).

With reference to FIGS. 1 and 2, the merchandiser 100 includes a frame 110 supporting the display fixture 105 and the components providing the refrigeration cycle (discussed below). As used herein, the term "frame" is broadly defined as something composed of parts fitted together and united. The frame 110 can include the housing of the unit, the one or more components of the refrigeration cycle, and/or the display fixture; and/or can provide the foundation for the housing, the one or more components of the refrigeration cycle, and/or the display fixture. The display fixture 105 comprises a cabinet, case, container or similar receptacle adapted to accommodate a commodity. The fixture 105 includes at least one surface 120 that at least partially defines an environmental space. For a "glass-door" display merchandiser, at least one of the surfaces defining the environmental space is partially defined by a translucent material.

Before proceeding further, it should be noted that for some merchandisers (e.g., some types of vending machines) and for some non-merchandiser refrigeration units (e.g., a "home refrigerator") the refrigeration unit does not include a display fixture. However, the refrigeration unit still includes at least one surface at least partially defining an environmental space. Also, the refrigeration unit 100 can include multiple environmental spaces. As used herein, the term "environmental space" is a three-dimensional space (defined at least in part by the at least one surface) where the environment is controlled by the refrigeration unit. For example, the merchandiser 100 of FIGS. 1 and 2 consists of two environmental spaces 130 and 135, where the temperatures of the environmental spaces are controlled by the components of the refrigeration cycle. Other characteristics (e.g., humidity) of the environment spaces 130 and 135 can be controlled.

It is also envisioned that, while the merchandiser 100 shown in FIGS. 1 and 2 is a self-contained refrigeration unit, aspects of the invention can be used in units that are not self-contained units. As used herein, the term "self-contained refrigerated unit" means a refrigeration unit where the frame of the unit supports the compressor, the condenser, the expansion valve, and the evaporator.

As best shown in FIG. 2, the components forming the refrigeration cycle comprises a linear compressor 140, a condenser 145, an expansion device 150 (also typically referred to as the expansion valve), and an evaporator 155, all of which are in fluid communication. Of course, the refrigeration cycle can include other components (e.g., FIG. 2 shows a receiver 158, a filter, etc.).

Figure 3:
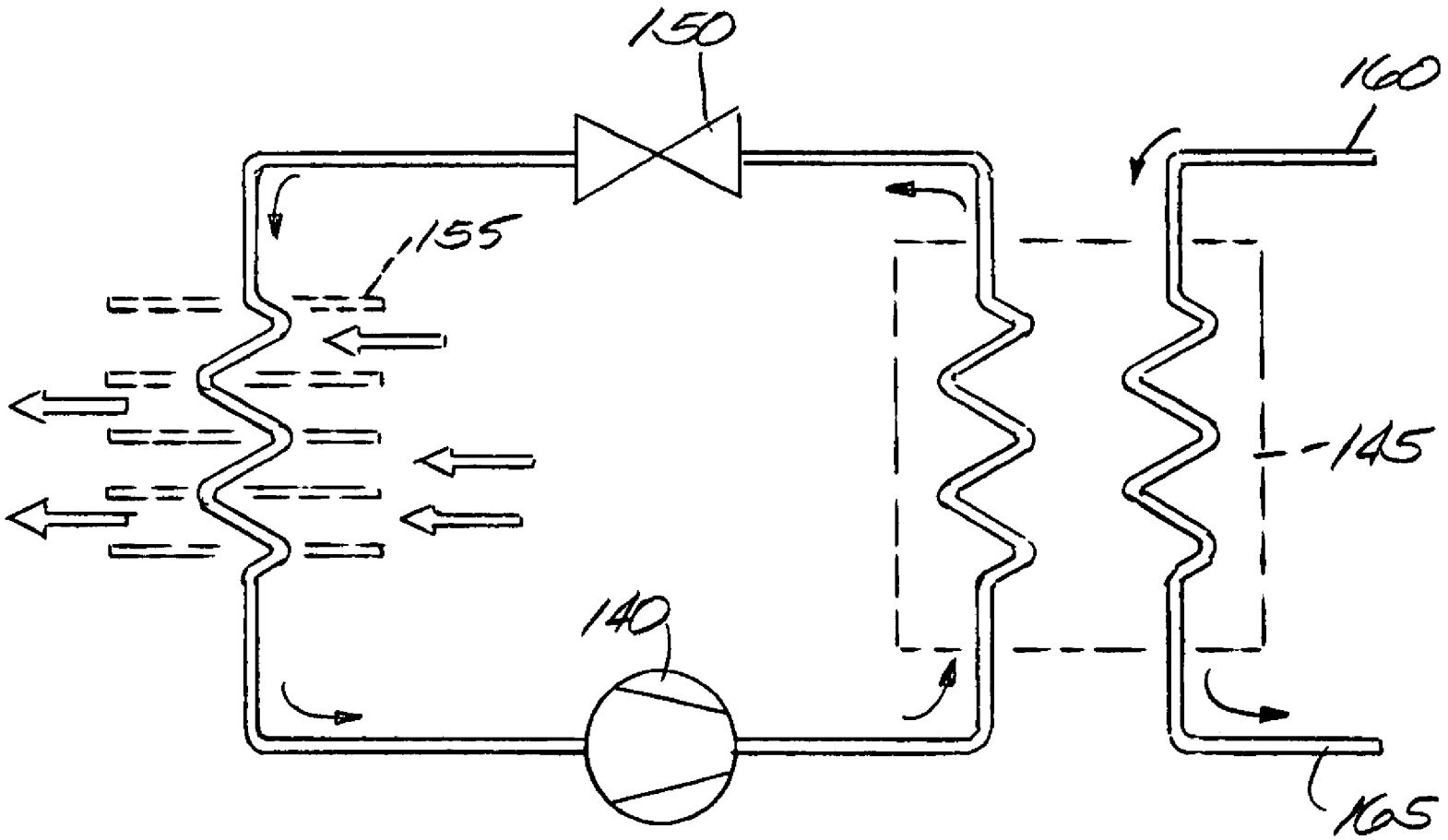
FIG. 3 is a schematic diagram representing the refrigeration cycle of the refrigeration merchandiser of FIG. 1.

During the refrigeration cycle, the compressor 140 compresses a refrigerant, resulting in the refrigerant increasing in temperature and pressure. The compressed refrigerant is sent out of the compressor 140 at a high-temperature, high-pressure heated gas. The refrigerant travels to the condenser 145. The condenser 145 changes the refrigerant from a high-temperature gas to a warm-temperature gas/liquid. Air and/or a liquid is used to help the condenser 145 with this transformation. For example and as shown in FIGS. 2 and 3, a secondary fluid (e.g., a liquid) provided by a fluid-input line 160 cools the condenser 145. A fluid-output line 165 discharges the fluid from the merchandiser 100, and a pump may be used to promote movement of the fluid. As will be discussed further below, the fluid can also be used to cool other components of the merchandiser 100. For other constructions, the merchandiser 100 can include a fan if the condenser 145 is air-cooled. However, a fan typically generates more acoustic noise than a liquid-cooled system, is less reliable than a liquid-cooled system, and if the condenser 145 is at the merchandiser 100, the moved air can raise the ambient air-temperature surrounding the merchandiser.

Referring back to FIG. 2, the refrigerant then travels to an expansion device 150 (two valves are shown). If the refrigeration system includes a receiver 160 (as shown in FIG. 2), the refrigerant can be stored in the receiver prior to being provided to the expansion device 150. The high-pressure gas/liquid communicated from the expansion device 150 to the evaporator 155 changes to a low-pressure gas. The expansion device 150 controls or meters the proper amount of refrigerant into the evaporator 155 (two evaporators are shown). The fluid enters the evaporator 155, which cools the environmental spaces 130 and 135. In some constructions, air and/or a liquid can be used with the evaporator 155 to promote this cooling action. Additionally, the design of the fixture 105 can promote the control of the environmental space. For example, the merchandiser 100 shown in FIGS. 1 and 2 include fans 170 designed to move air of the environmental spaces 130 and 135 over the coils of the evaporators 155, and the design of the fixture results in an "air curtain" where the fixture 105 is permanently open. The cool refrigerant then re-enters the compressor 140 to be pressurized again and the cycle repeats.

In one envisioned construction, the evaporator 155 is a finned evaporator, such as a Brazeway 44-pass evaporator manufactured by Brazeway, having a place of business in Adrian, Mich., USA; the expansion device 150 is a thermostatic expansion valve, such as a Sporlan TEV model BISE-½C expansion valve manufactured by Sporlan Valve Company, having a place of business in Washington, Mo.; the condenser 145 is a brazed heat exchanger available from SWEP North America, Inc., having a place of business in Duluth, Ga., USA; and the compressor 140 is a 60 Hz, 300 We input linear compressor obtainable from Sunpower, Inc., having a place of business in Athens, Ohio, USA.

As previously described, the merchandiser 100 includes a linear compressor 140. It is envisioned that, in some constructions, the linear compressor is a free-piston linear compressor, and in at least one envisioned construction, the free-piston linear compressor is a dual-opposing, free-piston linear compressor. A dual-opposing, free-piston linear compressor is obtainable from Sunpower, Inc., having a place of business in Athens, Ohio, USA. Another example of a dual-opposing, free-piston linear compressor is disclosed in U.S. Pat. No. 6,641,377, issued Nov. 4, 2003, the content of which is incorporated herein by reference.

The free-piston linear compressor has some basic differences over conventional rotary compressors. The free-piston device is driven by a linear motor in a resonant fashion (like a spring-mass damper) as opposed to being driven by a rotary motor and mechanical linkage. One advantage with the linear drive is that the side loads are small, which greatly reduces friction and allows use of simple gas bearings or low-viscosity oil bearings. In addition, since friction has been greatly reduced, the mechanical efficiency of the device is greater, internal heat generation is lower, and acoustic noise is reduced. Additionally, inherent variable piston stroke allows for efficient capacity modulation over a wide range. In constructions having dual-opposing pistons, the pistons vibrate against each other (i.e., provide a mirrored system) to virtually cancel all vibration. This reduces the acoustic noise of the linear compressor even further than a single piston linear compressor.

Figure 4:
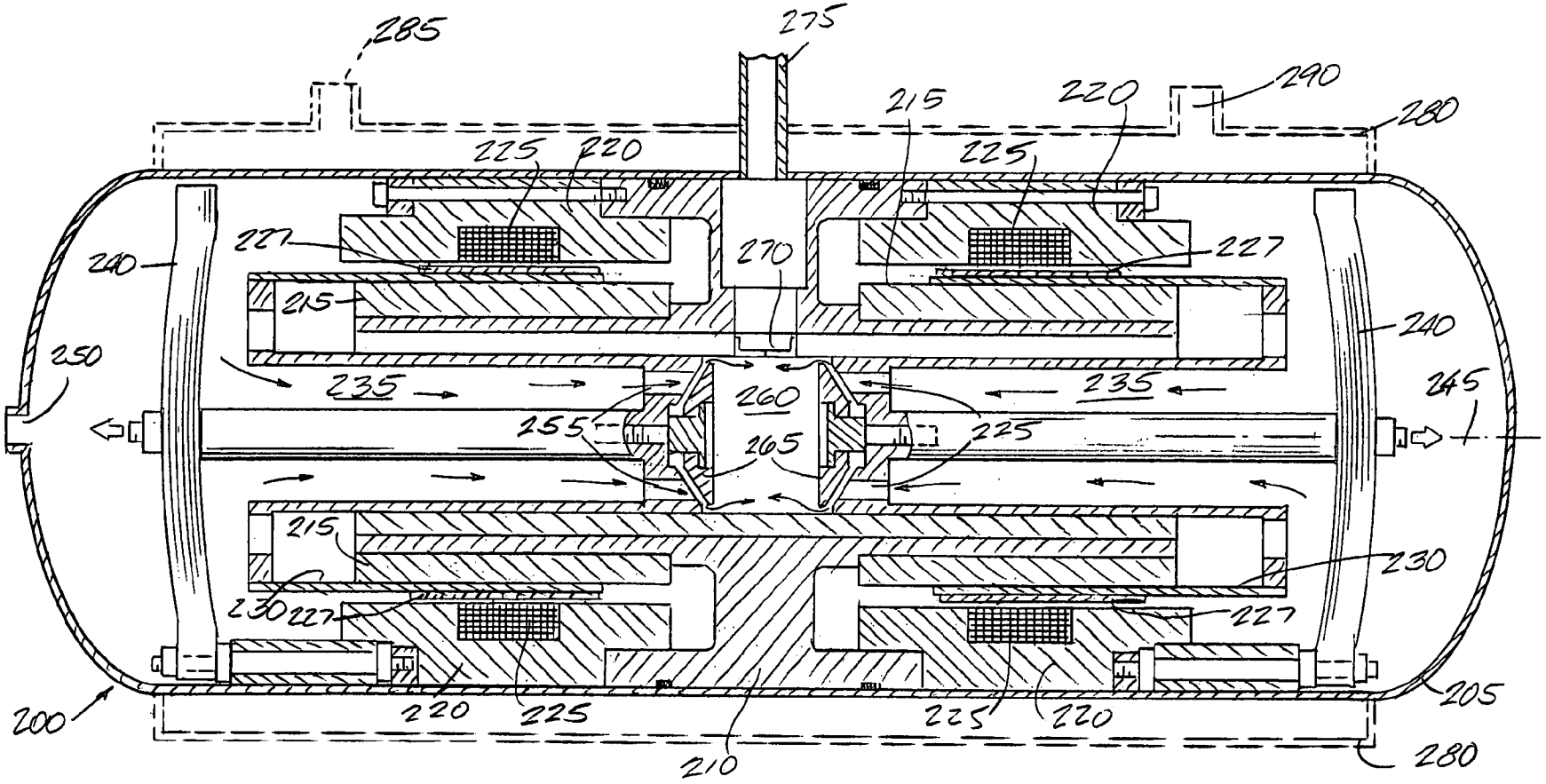
FIG. 4 is a sectional view of a dual opposing, free-piston linear compressor used in the refrigeration unit of FIG. 1 and shows the compressor at an intake stroke.
Figure 5:
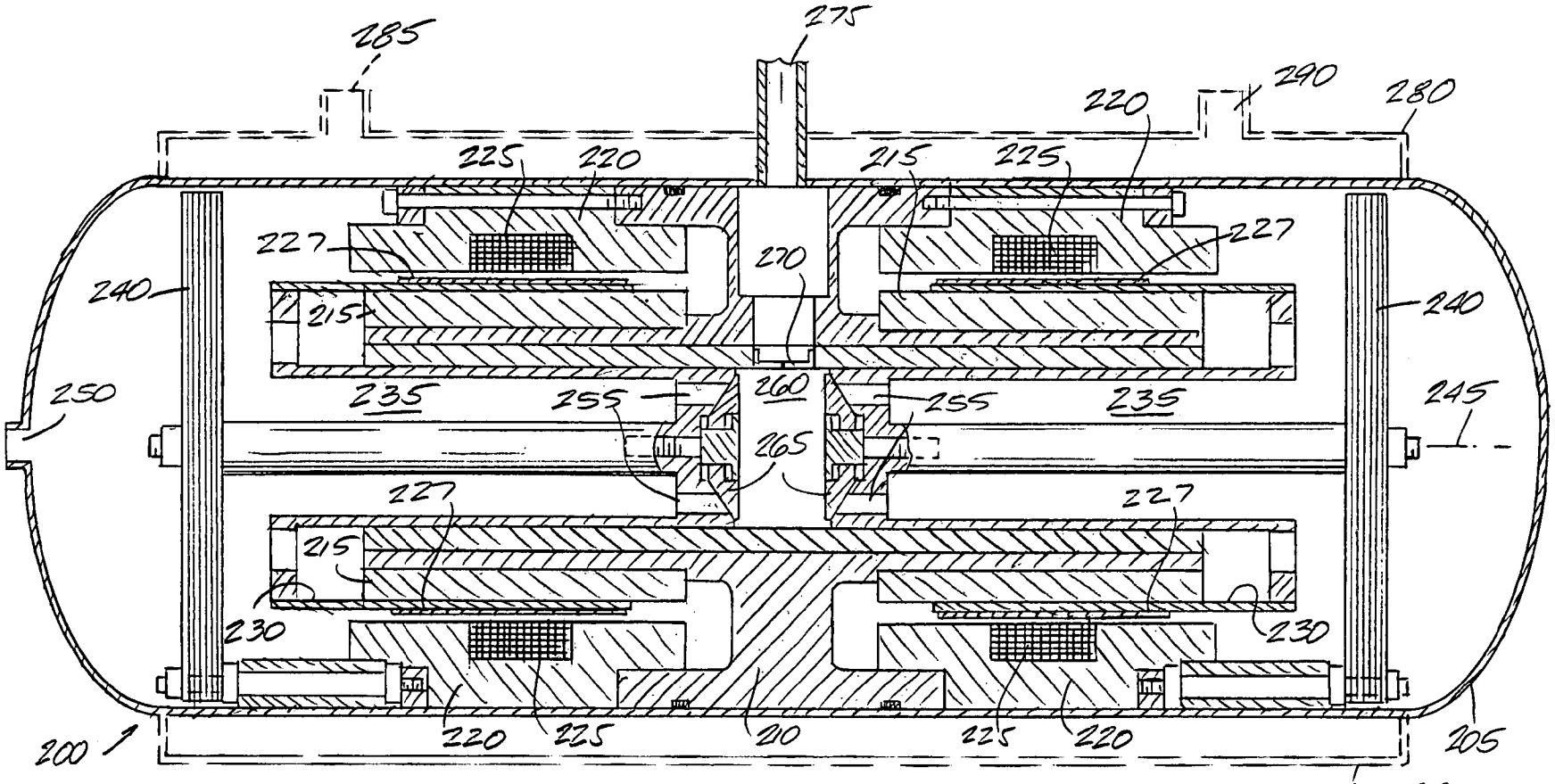
FIG. 5 is a sectional view of a dual opposing, free-piston linear compressor used in the refrigeration unit of FIG. 1 and shows the compressor at neutral.
Figure 6:
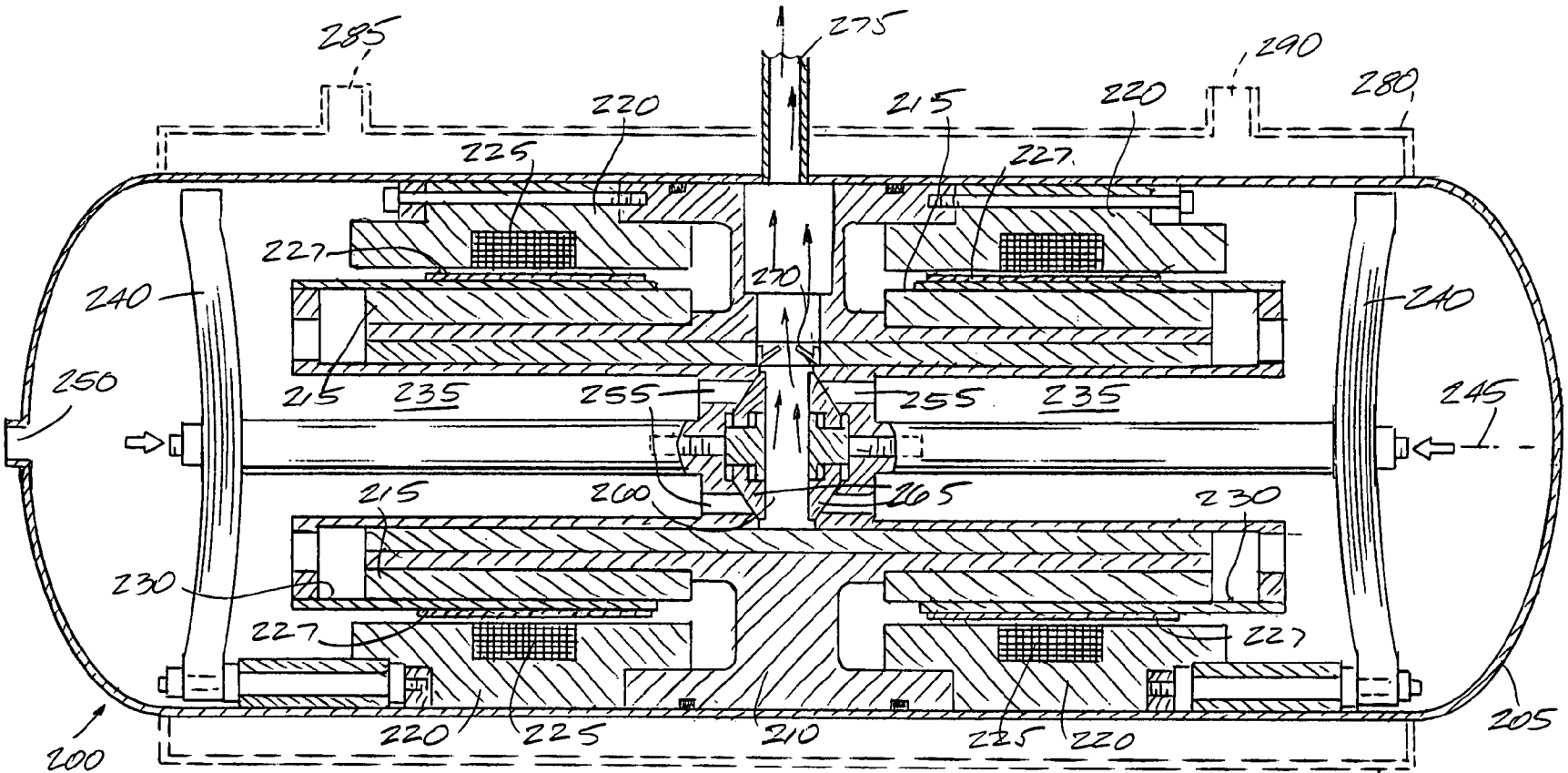
FIG. 6 is a sectional view of a dual opposing, free-piston linear compressor used in the refrigeration unit of FIG. 1 and shows the compressor at a compression stroke.

FIGS. 4, 5, and 6 show three sectional views of a dual-opposing linear compressor 200 capable of being used with the merchandiser 100. FIG. 4 shows the compressor 200 at an intake stroke, FIG. 5 shows the compressor 200 at neutral, and FIG. 6 shows the compressor 200 at a compression stroke. As shown in FIGS. 4, 5, and 6, the dual-opposing linear compressor 200 includes a housing 205 supporting a main body block 210. Inner and outer laminations 215 and 220 are secured to the main body block 210 and coils 225 are wound on the outer laminations 220, thereby resulting in stators. The stators, when energized, interact with magnet rings 227 mounted on outer cylinders 230. The outer cylinders 230 are fastened to pistons 235, which are secured to springs 240. The interaction between the magnet rings 227 and the energized stators results in the outer cylinders 230 moving the pistons 235 linearly along the axis of reciprocation 245. When the pistons 235 are at the intake stroke, refrigerant is allowed to flow from a suction port 250 through channels 255 into the compression space 260 (best shown in FIG. 4). When moving from the intake stroke to the compression stroke, the channels are closed by valves 265 (best shown in FIG. 5), and the refrigerant is compressed out through discharge valve 270 and discharge port 275 (best shown in FIG. 6). The linear motor allows for variable compression (e.g., from approximately thirty to one hundred percent) by the pistons 235, and therefore, the linear compressor 200 provides variable capacity control. In other words, the linear motors can cause the pistons to move a small stroke for a first volume, or to move a larger stroke for a second, larger volume. Accordingly, the merchandiser 100 allows for variable loads, decreases compressor cycling, and reduces temperature swings.

In some constructions, the linear compressor 200 can include a jacket 280 (shown in phantom) enclosing at least a portion of the housing 205. The jacket includes a fluid-input port 285 and a fluid-output port 290, and provides a plenum 300 containing a cooling fluid, thereby providing a fluid-cooled compressor. Other arrangements for cooling the compressor with a fluid are possible.

An example of a compressor controller for use with the dual-opposing, free-piston linear compressor shown in FIGS. 4–6 is disclosed in U.S. Pat. No. 6,536,326, issued Mar. 25, 2003, the content of which is incorporated herein by reference. It is also possible for the coolant fluid to be used for cooling the controller 300 (best shown in FIG. 2). Similar to the linear compressor, a jacket having input and output ports can be used to surround a housing of the controller.

As discussed earlier, the merchandiser 100 shown in FIGS. 1 and 2 is a self-contained refrigeration unit. One of the benefits of a self-contained refrigeration unit is that the manufacturer can completely assemble the unit and charge the refrigerant at the factory. Assembling and charging the unit at the factory decreases the likelihood of a leak. Also, the self-contained merchandiser 100 uses less piping and refrigerant than the larger refrigeration systems.

Referring again to FIG. 2, the merchandiser 100 includes a controller 300 that controls the merchandiser 100. The controller 300 includes one or more temperature sensors and/or one or more pressure sensors (only one sensor 302 is shown) coupled to the merchandiser. The controller 300 also includes a user input device. The controller 300 receives merchandiser input information (i.e., signals or data) from the sensor(s) 302, receives user input (e.g., temperature settings) from the user input device, processes the inputs, and provides one or more outputs to control the merchandiser 100 (e.g., to control the compressor, control the expansion device, control a defrost system, etc.).

For the merchandiser shown, the merchandiser controller 300 includes the compressor controller. However, the merchandiser controller 300 can be separated into multiple controllers (e.g., a controller for overall control and a compressor controller), which is typically referred to as a distributed control system. An example of a distributed control system is disclosed in U.S. Pat. No. 6,647,735, issued Nov. 18, 2003, the content of which is incorporated herein by reference.

In one envisioned construction, the controller 300 includes one or more programmable devices (e.g., one or more microprocessors, one or more microcontrollers, etc.) and a memory. The memory, which can include multiple memory devices, includes program storage memory and data storage memory. The one or more programmable devices receive instructions, receive information (either directly or indirectly) from the devices in communication with the programmable devices, execute the instructions, process the information, and communicate outputs to the attached devices.

The user-input device is shown in FIGS. 1 and 2 as a user interface 305. The user-input device can be as simple as a thermostat dial. Other user-input devices include push-buttons, switches, keypads, a touch screen, etc. The user interface 305 also includes a user-output device (e.g., a LCD display, LEDs, etc.). It is also envisioned that the user interface 305 can include connections for communication to other interfaces or computers.

It is envisioned that the controller 300 can use at least one of a sensed pressure and a sensed temperature to control the compressor 140, the expansion device 150, and/or the fans 170. By controlling these components, the controller 300 thereby controls the temperature of the environmental space (s) 130 and 135 of the merchandiser 100. For example, the controller 300 can include a temperature sensor that senses discharge air temperature. If the discharge air temperate is outside of a predetermined temperature range (e.g., set by an operator), the controller 300 can modulate or change the volume of the compressor 140 (e.g., increase or decrease the stroke of the pistons of the compressor 140). How the controller 300 changes the compressor volume can be based on empirical test data. Other methods known to those skilled in the art for controlling the compressor 140 are possible.

Other parameters used by the controller 300 for controlling the compressor 140 can include suction temperature, suction pressure, discharge pressure, evaporator air exit temperature, evaporator surface temperature, evaporator pressure, delta temperature between discharge and return air temperature, product zone temperatures, product simulator temperatures, and similar parameters.

Various other features and advantages of the invention are set forth in the following claims.

What is claimed is:

1. A refrigeration merchandiser comprising:

at least one surface at least partially defining an environmental space adapted to accommodate a commodity;

a linear compressor including a piston, a condenser, an expansion device, and an evaporator in fluid communication, the evaporator being in thermal communication with the environmental space to influence the temperature of the environmental space;

a frame supporting the at least one surface, the linear compressor, the condenser, the expansion device, and the evaporator; and a controller coupled to the linear compressor, the controller comprising a sensor configured to sense a parameter representative of an operating condition associated with the merchandiser, and wherein the controller is operable to control the linear compressor based at least in part on the sensed parameter, and further wherein the controller is operable to control the linear compressor by being further operable to control the stroke of the piston based at least in part on the sensed parameter.

2. A merchandiser as set forth in claim 1 wherein the frame comprises the at least one surface.

3. A merchandiser as set forth in claim 1 wherein the merchandiser further comprises a display fixture comprising the at least one surface and defining the environmental space.

4. A merchandiser as set forth in claim 3 wherein the frame comprises the display fixture.

5. A merchandiser as set forth in claim 3 wherein the environmental space is a permanently open space.

6. A merchandiser as set forth in claim 3 wherein at least a portion of the at least one surface is translucent.

7. A merchandiser as set forth in claim 1 wherein the linear compressor comprises a free-piston linear compressor.

8. A merchandiser as set forth in claim 1 wherein the merchandiser further comprises a fluid-input line and a fluid-output line, both of which being supported by the frame, wherein the condenser comprises a fluid-cooled condenser, and wherein the fluid input line, the fluid-cooled condenser, and the fluid-output line are all in fluid communication.

9. A merchandiser as set forth in claim 8, wherein the controller comprises a fluid-cooled controller, and wherein the fluid-input line, the fluid-cooled controller, and the fluid-output line are all in fluid communication.

10. A merchandiser as set forth in claim 8, wherein the linear compressor comprises a fluid-cooled linear compressor, and wherein the fluid-input line, the fluid-cooled linear compressor, and the fluid-output line are all in fluid communication.

11. A merchandiser as set forth in claim 1 wherein the controller further controls the operation of the merchandiser including controlling the temperature of the environmental space.

12. A merchandiser as set forth in claim 1 wherein the controller is further operable to control the expansion device based at least in part on the sensed parameter.

13. A merchandiser as set forth in claim 1 wherein the sensor comprises a pressure sensor, and wherein the sensed parameter comprises a sensed pressure.

14. A merchandiser as set forth in claim 1 wherein the sensor comprises a temperature sensor, and wherein the sensed parameter comprises a sensed temperature.

15. A stand-alone refrigeration merchandiser comprising:

a display fixture comprising at least one surface at least partially defining an environmental space, the display fixture being adapted to accommodate a commodity in the environmental space;

a free-piston linear compressor including a piston, a fluid-cooled condenser, an expansion device, and an evaporator in fluid communication, the evaporator being in thermal communication with the environmental space to influence the temperature of the environmental space;

a controller coupled to the free-piston linear compressor, the controller comprising a sensor configured to sense a parameter representative of an operating condition associated with the merchandiser, and wherein the controller is operable to control the free-piston linear compressor based at least in part on the sensed parameter, and further wherein the controller is operable to control the free-piston linear compressor by being further operable to control the stroke of the piston based at least in part on the sensed parameter.

a fluid input line and a fluid output line, both of which being in fluid communication with the fluid-cooled condenser; and a frame supporting the display case, the fluid-input line, the fluid-output line, the free-piston linear compressor, the fluid-cooled condenser, the expansion device, and the evaporator.

16. A merchandiser as set forth in claim 15 wherein the frame comprises the display fixture.

17. A merchandiser as set forth in claim 15 wherein the controller comprises a fluid-cooled controller, and wherein the fluid-input line, the fluid-cooled controller, and the fluid-output line are all in fluid communication.

18. A merchandiser as set forth in claim 15 wherein the controller further controls the operation of the merchandiser including controlling the temperature of the environmental space.

19. A merchandiser as set forth in claim 15 wherein the free-piston linear compressor comprises a fluid-cooled, free-piston linear compressor, and wherein the fluid-input line, the fluid-cooled, free-piston linear compressor, and the fluid-output line are all in fluid communication.

20. A merchandiser as set forth in claim 15 wherein the controller is further operable to control the expansion device based at least in part on the sensed parameter.

21. A merchandiser as set forth in claim 15 wherein the sensor comprises a pressure sensor, and wherein the sensed parameter comprises a sensed pressure.

22. A merchandiser as set forth in claim 15 wherein the sensor comprises a temperature sensor, and wherein the sensed parameter comprises a sensed temperature.

23. A refrigeration merchandiser comprising:

a display fixture comprising at least one surface at least partially defining an environmental space, the display fixture being adapted to accommodate a commodity in the environmental space;

a frame supporting the display fixture;

a free-piston linear compressor including a piston, a condenser, an expansion device, and an evaporator in fluid communication, the evaporator being in thermal communication with the environmental space to influence the temperature of the environmental space, and at least the free-piston linear compressor and the evaporator being supported by the frame; and a controller coupled to the free-piston linear compressor, the controller comprising a sensor configured to sense a parameter representative of an operating condition associated with the merchandiser, and wherein the controller is operable to control the free-piston linear compressor based at least in part on the sensed parameter, and further wherein the controller is operable to control the free-piston linear compressor by being further operable to control the stroke of the piston based at least in part on the sensed parameter.

24. A merchandiser as set forth in claim 23 wherein the frame further supports the condenser and the expansion device.

25. A merchandiser as set forth in claim 23 wherein the refrigeration system further comprises a fluid-input line and a fluid-output line, both of which being supported by the frame, wherein the condenser comprises a fluid-cooled condenser, and wherein the fluid-input line, fluid-cooled condenser, and fluid output line are all in fluid communication.

26. A merchandiser as set forth in claim 23 wherein the controller is further operable to control the expansion device based at least in part on the sensed parameter.

27. A merchandiser as set forth in claim 23 wherein the sensor comprises a pressure sensor, and wherein the sensed parameter comprises a sensed pressure.

28. A merchandiser as set forth in claim 23 wherein the sensor comprises a temperature sensor, and wherein the sensed parameter comprises a sensed temperature.

29. A refrigeration unit comprising:

at least one surface at least partially defining an environmental space;

a linear compressor including a piston, a fluid-cooled condenser, an expansion device, and an evaporator in fluid communication, the evaporator being in thermal communication with the environmental space to influence the temperature of the environmental space;

a controller coupled to the linear compressor, the controller comprising a sensor configured to sense a parameter representative of an operating condition associated with the merchandiser, and wherein the controller is operable to control the linear compressor based at least in part on the sensed parameter, and further wherein the controller is operable to control the linear compressor by being further operable to control the stroke of the piston based at least in part on the sensed parameter;

a fluid-input line and a fluid-output line, both of which being in fluid communication with the fluid-cooled condenser; and a frame supporting the at least one surface, the fluid-input line, the fluid-output line, the compressor, the fluid-cooled condenser, the expansion device, and the evaporator.

30. A refrigeration unit as set forth in claim 29 wherein the frame comprises the at least one surface.

31. A refrigeration unit as set forth in claim 29 wherein the linear compressor comprises a free-piston linear compressor.

32. A refrigeration unit as set forth in claim 29 wherein the controller comprises a fluid-cooled controller, and wherein the fluid-input line, the fluid-cooled controller, and the fluid-output line are all in fluid communication.

33. A refrigeration unit as set forth in claim 29 wherein the linear compressor comprises a fluid-cooled linear compressor, and wherein the fluid-input line, the fluid-cooled linear compressor, and the fluid-output line are all in fluid communication.

34. A refrigeration unit as set forth in claim 29 wherein the controller is further operable to control the expansion device based at least in part on the sensed parameter.

35. A refrigeration unit as set forth in claim 29 wherein the sensor comprises a pressure sensor, and wherein the sensed parameter comprises a sensed pressure.

36. A refrigeration unit as set forth in claim 29 wherein the sensor comprises a temperature sensor, and wherein the sensed parameter comprises a sensed temperature.

37. A refrigeration merchandiser comprising:

at least one surface at least partially defining an environmental space adapted to accommodate a commodity;

a free-piston linear compressor including dual-opposing pistons, a condenser, an expansion device, and an evaporator in fluid communication, the evaporator being in thermal communication with the environmental space to influence the temperature of the environmental space; and a frame supporting the at least one surface, the linear compressor, the condenser, the expansion device, and the evaporator.

38. A merchandiser as set forth in claim 37, and further comprising a controller to control operation of the linear compressor.

39. A merchandiser as set forth in claim 37, and further comprising a controller coupled to the linear compressor, the controller comprising a sensor configured to sense a parameter representative of an operating condition associated with the merchandiser, and wherein the controller is operable to control the linear compressor based at least in part on the sensed parameter, and further wherein the controller is operable to control the linear compressor by being further operable to control the stroke of the pistons for varying the effective displaced volume of refrigerant based at least in part on the sensed parameter.

40. A stand-alone refrigeration merchandiser comprising:

a display fixture comprising at least one surface at least partially defining an environmental space, the display fixture being adapted to accommodate a commodity in the environmental space;

a free-piston linear compressor including dual-opposing pistons, a fluid-cooled condenser, an expansion device, and an evaporator in fluid communication, the evaporator being in thermal communication with the environmental space to influence the temperature of the environmental space;

a fluid input line and a fluid output line, both of which being in fluid communication with the fluid-cooled condenser; and a frame supporting the display case, the fluid-input line, the fluid-output line, the free-piston linear compressor, the fluid-cooled condenser, the expansion device, and the evaporator.

41. A merchandiser as set forth in claim 40 and further comprising a controller to control the operation of the free-piston linear compressor.

42. A merchandiser as set forth in claim 40 and further comprising a controller coupled to the free-piston linear compressor, the controller comprising a sensor configured to sense a parameter representative of an operating condition associated with the merchandiser, and wherein the controller is operable to control the free-piston linear compressor based at least in part on the sensed parameter, and further wherein the controller is operable to control the free-piston linear compressor by being further operable to control the stroke of the pistons for varying the effective displaced volume of refrigerant based at least in part on the sensed parameter.

43. A refrigeration merchandiser comprising:

a display fixture comprising at least one surface at least partially defining an environmental space, the display fixture being adapted to accommodate a commodity in the environmental space;

a frame supporting the display fixture;

a free-piston linear compressor including dual-opposing pistons, a condenser, an expansion device, and an evaporator in fluid communication, the evaporator being in thermal communication with the environmental space to influence the temperature of the environmental space, and at least the free-piston linear compressor and the evaporator being supported by the frame.

44. A merchandiser as set forth in claim 43, and further comprising a controller to control the operation of the linear compressor.

45. A merchandiser as set forth in claim 43, and further comprising a controller coupled to the free-piston linear compressor, the controller comprising a sensor configured to sense a parameter representative of an operating condition associated with the merchandiser, and wherein the controller is operable to control the free-piston linear compressor based at least in part on the sensed parameter, and further wherein the controller is operable to control the free-piston linear compressor by being further operable to control the stroke of the pistons for varying the effective displaced volume of refrigerant based at least in part on the sensed parameter.

46. A refrigeration unit comprising:

at least one surface at least partially defining an environmental space;

a free-piston linear compressor including dual-opposing pistons, a fluid-cooled condenser, an expansion device, and an evaporator in fluid communication, the evaporator being in thermal communication with the environmental space to influence the temperature of the environmental space;

a fluid-input line and a fluid-output line, both of which being in fluid communication with the fluid-cooled condenser; and a frame supporting the at least one surface, the fluid-input line, the fluid-output line, the compressor, the fluid-cooled condenser, the expansion device, and the evaporator.

47. A refrigeration unit as set forth in claim 46 and further comprising a controller to control the operation of the linear compressor.

48. A refrigeration unit as set forth in claim 46 and further comprising a controller coupled to the linear compressor, the controller comprising a sensor configured to sense a parameter representative of an operating condition associated with the merchandiser, and wherein the controller is operable to control the linear compressor based at least in part on the sensed parameter, and further wherein the controller is operable to control the linear compressor by being further operable to control the stroke of the pistons for varying the effective displaced volume of refrigerant based at least in part on the sensed parameter.

* * * * *